US007323209B1

(12) United States Patent
Esbeck et al.

(10) Patent No.: US 7,323,209 B1
(45) Date of Patent: Jan. 29, 2008

(54) APPARATUS AND METHOD FOR COATING STENTS

(75) Inventors: Thomas D. Esbeck, Murrieta, CA (US); Andrew McNiven, Temecula, CA (US); Boyd Knott, Temecula, CA (US); Todd Thessen, San Marcos, CA (US); Kara Carter, Vista, CA (US); Joycelyn Amick, Temecula, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 590 days.

(21) Appl. No.: 10/438,378

(22) Filed: May 15, 2003

(51) Int. Cl.
*B05D 3/02* (2006.01)

(52) U.S. Cl. ..... 427/2.25

(58) Field of Classification Search ..... None
See application file for complete search history.

(56) References Cited

U.S. PATENT DOCUMENTS

| | | | | |
|---|---|---|---|---|
| 3,882,816 | A | 5/1975 | Rooz et al. | 118/57 |
| 4,459,252 | A | 7/1984 | MacGregor | 264/46.9 |
| 4,629,563 | A | 12/1986 | Wrasidlo | 210/500.34 |
| 4,733,665 | A | 3/1988 | Palmaz | 128/343 |
| 4,800,882 | A | 1/1989 | Gianturco | 128/343 |
| 4,865,879 | A | 9/1989 | Finlay | 472/140 |
| 4,886,062 | A | 12/1989 | Wiktor | 128/343 |
| 4,906,423 | A | 3/1990 | Frisch | 264/48 |
| 4,977,901 | A | 12/1990 | Ofstead | 128/772 |
| 5,037,427 | A | 8/1991 | Harada et al. | 606/108 |
| 5,059,211 | A | 10/1991 | Stack et al. | 606/198 |
| 5,112,457 | A | 5/1992 | Marchant | 204/165 |
| 5,163,952 | A | 11/1992 | Froix | 623/1 |
| 5,171,445 | A | 12/1992 | Zepf | 210/500.27 |
| 5,188,734 | A | 2/1993 | Zepf | 210/490 |
| 5,229,045 | A | 7/1993 | Soldani | 264/41 |
| 5,234,457 | A | 8/1993 | Andersen | 606/198 |
| 5,306,286 | A | 4/1994 | Stack et al. | 606/198 |
| 5,328,471 | A | 7/1994 | Slepian | 604/101 |
| 5,455,040 | A | 10/1995 | Marchant | 424/426 |
| 5,464,650 | A | 11/1995 | Berg et al. | 427/2.3 |
| 5,514,154 | A | 5/1996 | Lau et al. | 606/195 |

(Continued)

FOREIGN PATENT DOCUMENTS

| | | |
|---|---|---|
| EP | 0 665 023 | 8/1995 |

(Continued)

OTHER PUBLICATIONS

U.S. Appl. No. 09/894,248, filed Jun. 27, 2001, Pacetti et al.

(Continued)

*Primary Examiner*—Erma Cameron
(74) *Attorney, Agent, or Firm*—Squire Sanders & Dempsey, LLP

(57) ABSTRACT

An apparatus and method is provided for forming coatings on stents. The apparatus includes a temperature adjusting element that can increase or decrease the temperature of the stent. The apparatus can support a stent during the application of a coating composition to the stent. The apparatus can include a mandrel to support a stent and a temperature element integrated with the mandrel to adjust the temperature of the mandrel. The temperature element can include a heating coil or a heating pin, for example, disposed in the mandrel.

23 Claims, 4 Drawing Sheets

U.S. PATENT DOCUMENTS 5,527,337 A 6/1996 Stack et al. ..... 606/198
5,537,729 A 7/1996 Kolobow ..... 29/527.2
5,558,900 A 9/1996 Fan et al. ..... 427/2.28
5,569,295 A 10/1996 Lam ..... 606/198
5,578,073 A 11/1996 Haimovich et al. ..... 623/1
5,603,721 A 2/1997 Lau et al. ..... 606/195
5,605,696 A 2/1997 Eury et al. ..... 424/423
5,611,775 A 3/1997 Machold et al. ..... 604/53
5,624,411 A 4/1997 Tuch ..... 604/265
5,628,730 A 5/1997 Shapland et al. ..... 604/21
5,628,786 A 5/1997 Banas et al. ..... 623/1
5,667,767 A 9/1997 Greff et al. ..... 424/9.411
5,670,558 A 9/1997 Onishi et al. ..... 523/112
5,700,286 A 12/1997 Tartaglia et al. ..... 623/1
5,713,949 A 2/1998 Jayaraman ..... 623/1
5,716,981 A 2/1998 Hunter et al. ..... 514/449
5,718,861 A * 2/1998 Andrews et al. ..... 264/235
5,766,710 A 6/1998 Turnlund et al. ..... 428/36.1
5,769,883 A 6/1998 Buscemi et al. ..... 623/1
5,772,864 A 6/1998 Møller et al. ..... 205/73
5,788,626 A 8/1998 Thompson ..... 600/36
5,795,318 A * 8/1998 Wang et al. ..... 604/8
5,800,392 A 9/1998 Racchini ..... 604/96
5,820,917 A 10/1998 Tuch ..... 427/2.1
5,823,996 A 10/1998 Sparks ..... 604/96
5,824,049 A 10/1998 Ragheb et al. ..... 623/1
5,830,178 A 11/1998 Jones et al. ..... 604/49
5,833,659 A 11/1998 Kranys ..... 604/96
5,837,313 A 11/1998 Ding et al. ..... 427/2.21
5,843,172 A 12/1998 Yan ..... 623/1
5,851,508 A 12/1998 Greff et al. ..... 424/9.411
5,855,598 A 1/1999 Pinchuk ..... 623/1
5,855,600 A 1/1999 Alt ..... 623/1
5,858,746 A 1/1999 Hubbell et al. ..... 435/177
5,865,814 A 2/1999 Tuch ..... 604/265
5,873,904 A 2/1999 Ragheb et al. ..... 623/1
5,891,108 A 4/1999 Leone et al. ..... 604/265
5,891,507 A 4/1999 Jayaraman ..... 427/2.25
5,895,407 A 4/1999 Jayaraman ..... 606/198
5,897,911 A 4/1999 Loeffler ..... 427/2.25
5,922,393 A 7/1999 Jayaraman ..... 427/2.3
5,928,279 A * 7/1999 Shannon et al. ..... 623/1.13
5,935,135 A 8/1999 Bramfitt et al. ..... 606/108
5,948,018 A 9/1999 Dereume et al. ..... 623/1
5,971,954 A 10/1999 Conway et al. ..... 604/96
5,972,027 A 10/1999 Johnson ..... 623/1
5,980,928 A 11/1999 Terry ..... 424/427
5,980,972 A 11/1999 Ding ..... 427/2.24
6,010,530 A 1/2000 Goicoechea ..... 623/1
6,010,573 A 1/2000 Bowlin ..... 118/620
6,015,541 A 1/2000 Greff et al. ..... 424/1.25
6,030,371 A 2/2000 Pursley ..... 604/282
6,042,875 A 3/2000 Ding et al. ..... 427/2.24
6,045,899 A 4/2000 Wang et al. ..... 428/315
6,051,648 A 4/2000 Rhee et al. ..... 525/54.1
6,056,993 A 5/2000 Leidner et al. ..... 427/2.25
6,060,451 A 5/2000 DiMaio et al. ..... 514/13
6,071,305 A 6/2000 Brown et al. ..... 623/1
6,080,488 A 6/2000 Hostettler et al. ..... 428/423.3
6,096,070 A 8/2000 Ragheb et al. ..... 623/1
6,099,562 A 8/2000 Ding et al. ..... 623/1.46
6,110,188 A 8/2000 Narciso, Jr. ..... 606/153
6,113,629 A 9/2000 Ken ..... 623/1.1
6,120,536 A 9/2000 Ding et al. ..... 623/1.43
6,120,847 A 9/2000 Yang et al. ..... 427/335
6,120,904 A 9/2000 Hostettler et al. ..... 428/423.3
6,121,027 A 9/2000 Clapper et al. ..... 435/180
6,126,686 A 10/2000 Badylak et al. ..... 623/1.24
6,129,755 A 10/2000 Mathis et al. ..... 623/1.15
6,129,761 A 10/2000 Hubbell ..... 623/11
6,153,252 A 11/2000 Hossainy et al. ..... 427/2.3
6,156,373 A 12/2000 Zhong et al. ..... 427/2.28
6,165,212 A 12/2000 Dereume et al. ..... 623/1.13
6,171,334 B1 1/2001 Cox ..... 623/1.15
6,203,569 B1 3/2001 Wijay ..... 623/1.15
6,206,915 B1 3/2001 Fagan et al. ..... 623/142
6,214,115 B1 4/2001 Taylor et al. ..... 118/423
6,245,099 B1 6/2001 Edwin et al. ..... 623/1.13
6,254,632 B1 7/2001 Wu et al. ..... 623/1.15
6,258,121 B1 7/2001 Yang et al. ..... 623/1.46
6,273,908 B1 8/2001 Ndondo-Lay ..... 623/1
6,273,910 B1 8/2001 Limon ..... 623/1.15
6,273,913 B1 8/2001 Wright et al. ..... 623/1.42
6,279,368 B1 8/2001 Escano et al. ..... 72/342.1
6,287,628 B1 9/2001 Hossainy et al. ..... 427/2.3
6,299,604 B1 10/2001 Ragheb et al. ..... 604/265
6,306,176 B1 10/2001 Whitbourne ..... 623/23.59
6,322,847 B1 11/2001 Zhong et al. ..... 427/2.28
6,358,567 B2 3/2002 Pham et al. ..... 427/421
6,364,903 B2 4/2002 Tseng et al. ..... 623/1.15
6,379,381 B1 4/2002 Hossainy et al. ..... 623/1.42
6,387,118 B1 5/2002 Hanson ..... 623/1.11
6,395,326 B1 5/2002 Castro et al. ..... 427/2.24
6,416,543 B1 7/2002 Hilaire et al. ..... 623/1.16
6,447,835 B1 * 9/2002 Wang et al. ..... 427/2.24
6,506,437 B1 1/2003 Harish et al. ..... 427/2.25
6,521,284 B1 2/2003 Parsons et al. ..... 427/2.24
6,527,863 B1 3/2003 Pacetti et al. ..... 118/500
6,534,112 B1 3/2003 Bouchier et al. ..... 427/2.24
6,565,659 B1 5/2003 Pacetti et al. ..... 118/500
6,572,644 B1 6/2003 Moein ..... 623/1.11
6,605,154 B1 8/2003 Villareal ..... 118/500
2003/0050687 A1 * 3/2003 Schwade et al. ..... 623/1.15
2004/0061261 A1 * 4/2004 Gonzalez et al. ..... 264/403

FOREIGN PATENT DOCUMENTS

EP 0 850 651 7/1998
EP 0 875 218 11/1998
EP 0 970 711 1/2000
JP 11299901 11/1999
WO WO 90/01969 3/1990
WO WO 91/12846 9/1991
WO WO 97/45105 12/1997
WO WO 98/23228 6/1998
WO WO 99/16386 4/1999
WO WO 99/63981 12/1999
WO WO 00/02599 1/2000
WO WO 00/12147 3/2000
WO WO 00/64506 11/2000
WO WO 01/00112 1/2001
WO WO 01/01890 1/2001
WO WO 01/45763 6/2001

OTHER PUBLICATIONS

U.S. Appl. No. 09/894,293, filed Jun. 27, 2001, Roorda et al.
U.S. Appl. No. 09/896,000, filed Jun. 28, 2001, Pacetti et al.
U.S. Appl. No. 10/254,203, filed Sep. 24, 2002, Kerrigan.
U.S. Appl. No. 10/255,913, filed Sep. 26, 2002, Tang et al.
U.S. Appl. No. 10/304,669, filed Nov. 25, 2002, Madriaga et al.
U.S. Appl. No. 10/319,042, filed Dec. 12, 2002, Van Sciver et al.
U.S. Appl. No. 10/330,412, filed Dec. 27, 2002, Hossainy et al.
U.S. Appl. No. 10/376,027, filed Feb. 26, 2003, Kokish et al.
Barath et al., *Low Dose of Antitumor Agents Prevents Smooth Muscle Cell Proliferation After Endothelial Injury*; JACC vol. 13, No. 2; Feb. 1989:252A (Abstract).
Dichek et al., *Seeding of Intravascular Stents With Genetically Engineered Endothelial Cells,* Circulation 1989; 1347-1353.
Forester et al., *A Paradigm for Restenosis Based on Cell Biology: Clues for the Development of New Preventive Therapies*; J. Am. Coll. Cardio. 1991; 17;758-769.
Matsumaru et al.; *Embolic Materials for Endovascular Treatment of Cerebral Lesions*; J. Biomatter Sci. Polymer Edn., vol. 8, No. 7 (1997) pp. 555-569.

Miyasaki et al., *Antitumor Effect of Implanted Ethylene-Vinyl Alcohol Copolymer Matrices Containing Anticancer Agents on Ehrlich Ascites Carcinoma and P388 Leukemia in Mice*; Chem. Pharm. Bull. 33(6) (1985) pp. 2490-2498.

Miyazawa et al., *Effects of Pemirolast and Tranilast on Intimal Thickening After Arterial Injury in the Rat*; J. Cardiovasc. Pharmacol. (1997) pp. 157-162.

Ohsawa et al., Preventive Effects of an Antiallergic Drug, Pemirolast Potassium, on Restenosis After Percutaneous Transluminal Coronary Angioplasty; American Heart Journal (1998) pp. 1081-1087.

Shigeno, *Prevention of Cerebrovascular Spasm by Bosentan, Novel Endothelin Receptor*; Chemical Abstract 125:212307 (1996).

* cited by examiner

APPARATUS AND METHOD FOR COATING STENTS

TECHNICAL FIELD

The present invention relates to an apparatus and method for coating stents.

BACKGROUND

Blood vessel occlusions are commonly treated by mechanically enhancing blood flow in the affected vessels, such as by employing a stent. Stents act as scaffolding, functioning to physically hold open and, if desired, to expand the wall of affected vessels. Typically stents are capable of being compressed, so that they can be inserted through small lumens via catheters, and then expanded to a larger diameter once they are at the desired location. Examples in the patent literature disclosing stents include U.S. Pat. No. 4,733,665 issued to Palmaz, U.S. Pat. No. 4,800,882 issued to Gianturco, and U.S. Pat. No. 4,886,062 issued to Wiktor.

FIG. 1 illustrates a conventional stent 10 formed from a plurality of struts 12. The plurality of struts 12 are radially expandable and interconnected by connecting elements 14 that are disposed between adjacent struts 12, leaving lateral openings or gaps 16 between adjacent struts 12. Struts 12 and connecting elements 14 define a tubular stent body having an outer, tissue-contacting surface and an inner surface.

Stents are used not only for mechanical intervention but also as vehicles for providing biological therapy. Biological therapy can be achieved by medicating the stents. Medicated stents provide for the local administration of a therapeutic substance at a diseased site. Local delivery of a therapeutic substance is a preferred method of treatment because the substance is concentrated at a specific site and thus, smaller total levels of medication can be administered in comparison to systemic dosages that often produce adverse or even toxic side effects, for the patient.

One method of medicating a stent involves the use of a polymeric carrier coated onto the surface of the stent. A composition including a solvent, a polymer dissolved in the solvent, and a therapeutic substance dispersed in the blend is applied to the stent by immersing the stent in the composition or by spraying the composition onto the stent. The solvent is allowed to evaporate, leaving on the stent surfaces a coating of the polymer and the therapeutic substance impregnated in the polymer.

A shortcoming of the above-described method of medicating a stent is the potential for coating defects due to the nature of the composition applied to the stent. For solvents that evaporate slowly, or "non-volatile" solvents, the liquid composition that is applied to a relatively small surface of the stent can flow, wick and collect during the coating process. As the solvent evaporates, the excess composition hardens, leaving clumps or pools of polymer on the struts or "webbing" between the struts. For solvents that evaporate very fast, or "volatile solvents," the coating can be rough with a powder like consistency.

For slow evaporating solvents, heat treatment has been implemented to induce the evaporation of the solvent. For example, the stent can be placed in an oven at an elevated temperature (e.g., 60 deg. C. to 80 deg. C.) for a duration of time, for example, at least 30 minutes, to dry the coating. Such heat treatments have not reduced pooling or webbing of the polymer. Moreover, prolonged heat treatment can adversely affect drugs that are heat sensitive and may cause the warping of the stent. The manufacturing time of the stent is also extending for the time the stent is treated in the oven.

An apparatus and method is needed to address these problems. The embodiments of this invention address these and other problems associated with coating stents.

SUMMARY

An apparatus to support a stent during the application of a coating composition to a stent, is provided comprising: a mandrel to support a stent during application of a coating composition to the stent; and a temperature element integrated with the mandrel to adjust the temperature of the mandrel. In one embodiment, the inner surface of the stent is in contact with the outer surface of the mandrel. Alternatively, the outer surface of the mandrel is not in contact with the inner surface of the stent or with a majority of the inner surface of the stent. The temperature element can increase or decrease the temperature of the stent to a temperature other than room temperature. In one embodiment, the temperature element includes a heating coil or heating pin disposed within the mandrel. Alternatively, the temperature element can be a lumen or conduit disposed inside of the mandrel for receiving a fluid or a gas. The temperature of the fluid or gas can be adjusted to vary the temperature of the mandrel. A temperature controller can also be provided to adjust the temperature of the temperature element.

A method of coating a stent is provided comprising: positioning a stent on a mandrel assembly; applying a coating composition to the stent; adjusting the temperature of the mandrel assembly to change the temperature of the stent. The mandrel assembly can include a temperature element integrated therewith to allow a user to adjust the temperature of the stent. In one embodiment, the temperature of the mandrel assembly is adjusted prior to the application of the coating composition to the stent. The temperature can be maintained at the same level or adjusted during the coating process. In an alternative embodiment, the temperature of the mandrel assembly can be adjusted subsequent to the termination of the application of the composition to the stent. In yet another embodiment, the temperature of the mandrel is adjusted during the application of the coating composition to the stent. The temperature can be maintained at a constant level or adjusted at anytime as the user sees fit.

A method of coating a stent is also provided, comprising: applying a coating composition to the stent; and inserting a temperature adjusting element within the longitudinal bore of the stent to change the temperature of the stent. The temperature adjusting element does not contact the inner surface of the stent during this process. Alternatively, a user can touch the inner surface of the stent with the temperature adjusting element.

DETAILED DESCRIPTION

Figure 1:
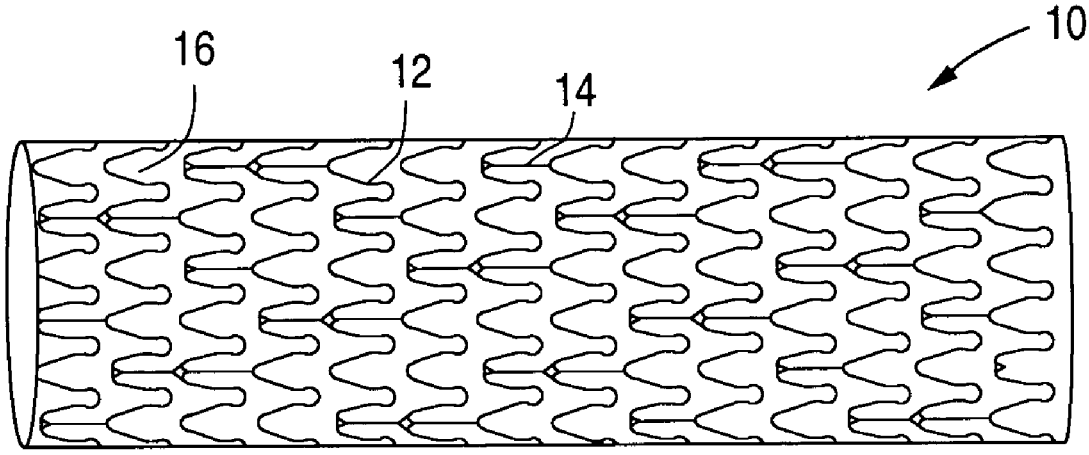
FIG. 1 (PRIOR ART)
FIG. 1 is a conventional stent.
Figure 2:
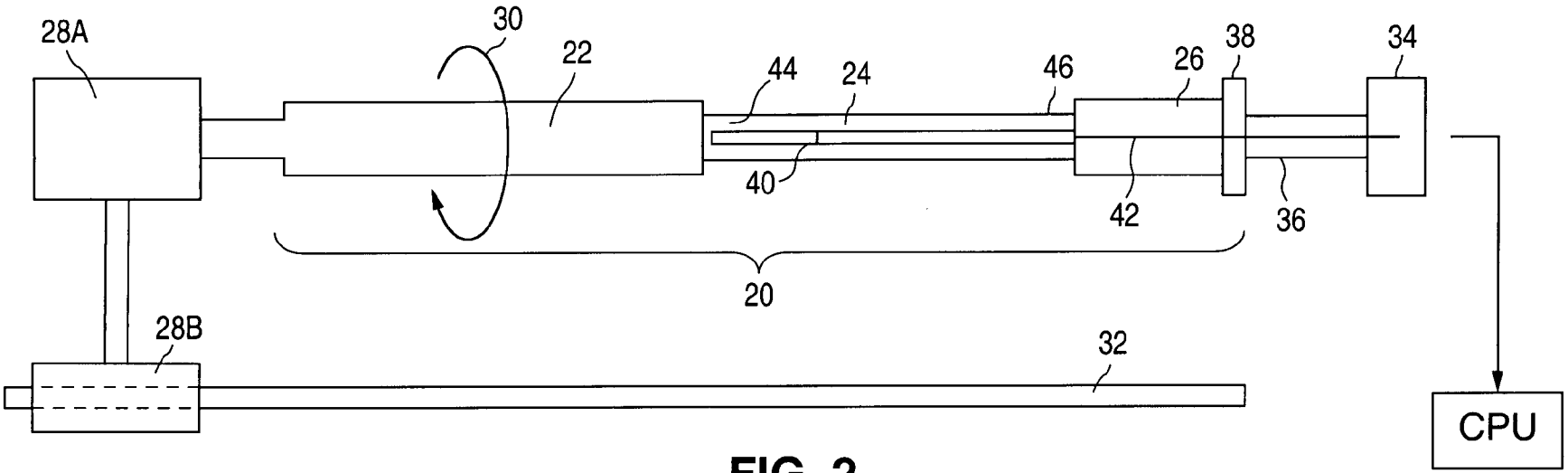
FIGS. 2-4 are support assemblies according to various embodiments of the invention.
Figure 3:
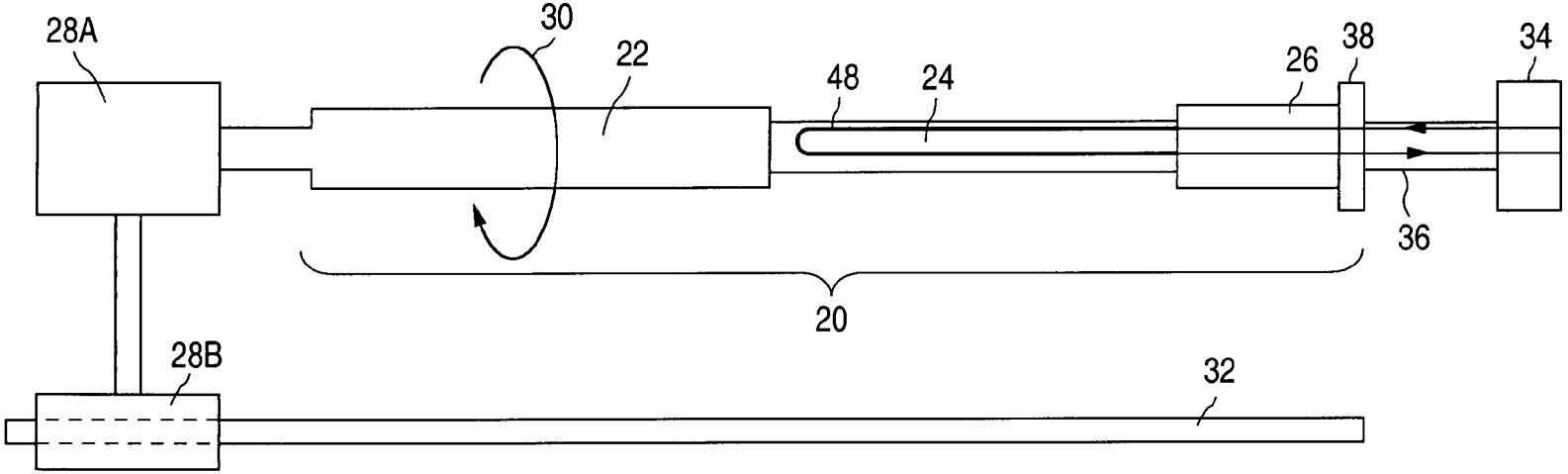

FIGS. 2 and 3 illustrate an apparatus that can be used for coating an implantable medical device such as a stent. A stent mandrel fixture 20 supports a stent and includes a support member 22, a mandrel 24, and a lock member 26. Support member 22 can connect to a motor 28A so as to provide rotational motion about the longitudinal axis of a stent, as depicted by arrow 30, during the coating process. Another motor 28B can also be provided for moving fixture 20 in a linear direction, back and forth, along a rail 32. The type of stent that can be crimped on mandrel 24 is not of critical significance. The term stent is broadly intended to include self- and balloon-type expandable stents as well as stent-grafts.

Lock member 26 is coupled to a temperature control device or temperature controller 34 via a conduit 36. A coupler 38 allows the stent mandrel fixture 20 to rotate with respect to conduit 36 and temperature controller 34. Temperature controller 34 can be in communication with a CPU for allowing a user to adjust and determine the temperature of mandrel 24 during the coating process. Sensors could be positioned anywhere along the length of mandrel 24, preferably where mandrel 24 is in contact with the stent for measuring the temperature of the stent structure and providing feedback to the CPU. A temperature element 40, disposed or embedded within, on the exterior surface mandrel 24, or coupled or connected to mandrel, is in communication with temperature controller 34 via a connecting line 42. Temperature element 40 can be, for example, a heating coil pin or any other suitable mechanism capable of heating mandrel 24 to a desired temperature. The temperature element 40 should extend along the length of mandrel 24 so as to provide an even application of heat along the length of a stent. Mandrel 24 should be made from a material that conducts heat efficiently, such as stainless steel, and can be coated with a non-stick material such as TEFLON.

Support member 22 is coupled to a first end 44 of mandrel 24. Mandrel 24 can be permanently affixed to support member 22. Alternatively, support member 22 can include a bore for receiving first end 44 of mandrel 24. First end 44 of mandrel 24 can be threaded to screw into the bore. Alternatively, a non-threaded first end 44 of mandrel 24 can be press-fitted or friction-fitted within the bore. The bore should be deep enough so as to allow mandrel 24 to securely mate with support member 22. The depth of the bore can be over-extended so as to allow a significant length of mandrel 24 to penetrate the bore. This would allow the length of mandrel 24 to be adjusted to accommodate stents of various sizes.

Lock member 26 includes a flat end that can be permanently affixed to a second end 46 of mandrel 24 if end 44 of mandrel 24 is disengagable from support member 22. Mandrel 24 can have a threaded second end 46 for screwing into a bore of lock member 26. A non-threaded second end 46 and bore combination can also be employed such that second end 46 of mandrel 24 is press-fitted or friction-fitted within the bore of lock member 26. Lock member 26 can, therefore, be incrementally moved closer to support member 22 to allow stents of any length to be securely pinched between flat ends of the support and lock members 22 and 26. A stent need not, however, be pinched between these ends. A stent can be simply crimped tightly on mandrel 24. Should the design include a mandrel that is disengagable from lock member 26, electrical components need be used to allow connecting line 42 to be functionally operable when all the components are assembled.

FIG. 3 illustrates another embodiment of the invention, wherein a fluid line 48 runs through mandrel 24, lock member 26, and conduit 36 to temperature controller 34. A gas or fluid, such as water, can be circulated through mandrel 24 and controller 34 can adjust the temperature of the fluid. The temperature of the fluid can be both cold and warm, as will be described in more detail below. Cold fluid application can be used with solvents that evaporate more quickly.

Figure 4:
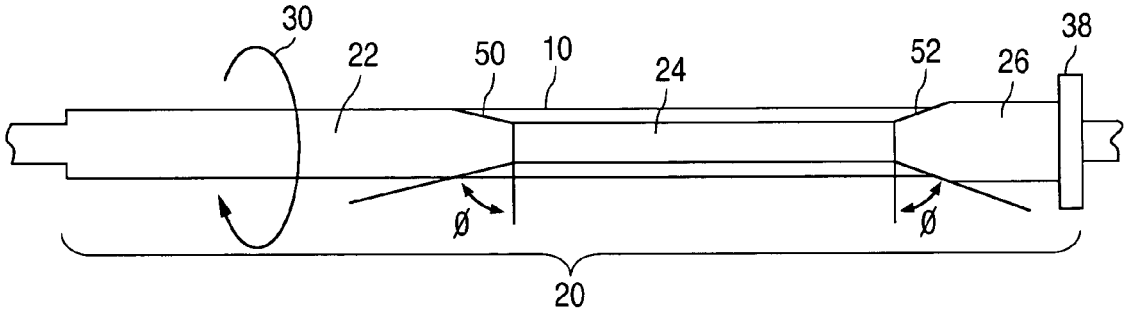

In FIGS. 2 and 3, the outer surface of mandrel 24 can be in direct contact with the inner surface of a stent. However, a gap can be provided between the outer surface of mandrel 24 and the inner surface of a stent. This gap can be created any suitable number of different ways, such as by having protruding elements or fins (not shown) extending out from mandrel 24 or by using the design illustrated by FIG. 4. FIG. 4 illustrates a stent mandrel fixture 20 in which support member 22 and lock member 26 include coning end portions 50 and 52, instead of the flat ends, for penetrating into ends of stent 10. The coning end portions 50 and 52 can taper inwardly at an angle Ø of about 15° to about 75°, more narrowly from about 30° to about 60°. By way of example, angle Ø can be about 45°. The outer diameter of mandrel 24 can be smaller than the inner diameter of stent 10, as positioned on fixture 20, so as to prevent the outer surface of mandrel 24 from making contact with the inner surface of stent 10. As best illustrated by FIG. 4, a sufficient clearance between the outer surface of mandrel 24 and the inner surface of stent 10 is provided to prevent mandrel 24 from obstructing the pattern of the stent body during the coating process. By way of example, the outer diameter of mandrel 24 can be from about 0.010 inches (0.254 mm) to about 0.017 inches (0.432 mm) when stent 10 has a mounted inner diameter of between about 0.025 inches (0.635 mm) and about 0.035 inches (0.889 mm). Contact between stent 10 and fixture 20 is limited as stent 10 only rests on coning ends 50 and 52.

Figure 5:
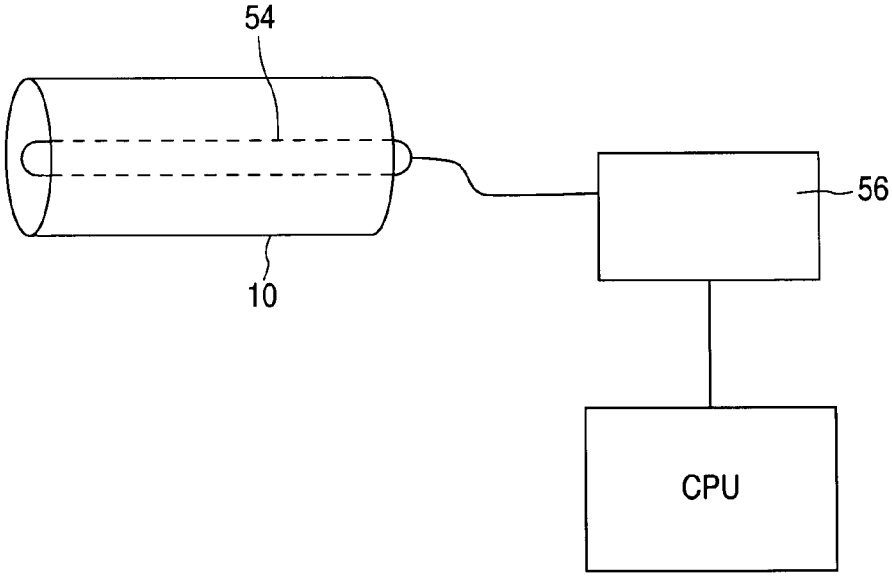
FIG. 5 is a temperature adjustment element inserted into a stent.

In accordance with another embodiment of the invention, in lieu of or in addition to using stent mandrel fixture 20, a heating pin 54 (e.g., a TEFLON covered electrical heating element), as illustrated by FIG. 5, can be used subsequent to the application of the coating composting to stent 10. Heating pin 54 is coupled to a temperature controller or thermo-coupler 56, which in turn is connected to a CPU. Thermo-coupler 56 in the feedback loop senses the temperature of heating pin 54 and relays a signal to the CPU which in turn adjusts the heat supplied to heating pin 54 to maintain a desired temperature. The controller can be, for example, a Eurotherm controller.

A coating composition can be applied to a stent, for example by spraying. The stent can be rotated about its longitudinal axis and/or translated backward and forward along its axis to traverse a stationery spray nozzle. In one embodiment, prior to the application of the coating composition, the temperature of mandrel 24 can be adjusted either below or above room temperature. If the solvent has a vapor pressure greater than, for example, 17.54 Torr at ambient temperature, the temperature of mandrel 24 can be adjusted to inhibit evaporation of the solvent. If the solvent has a vapor pressure of less than, for example, 17.54 Torr at ambient temperature, the temperature of mandrel 24 can be adjusted to induce the evaporation of the solvent. For example, temperature of mandrel 24 can be adjusted to anywhere between, for example 40 deg. C. to 120 deg. C. for non-volatile solvents. Temperatures of less than 25 deg. C. can be used for the more volatile solvents.

The temperature can be adjusted prior to or during the application of the coating composition. The temperature of mandrel 24 can be maintained at a generally steady level through out the application of the composition or the coating process, or until a significant amount to the solvent is removed such that the coating is in a completely dry state or a semi-dry state. By way of example, the temperature of mandrel 24 can be set to 60 deg. C. prior to the application of the coating composition and maintained at 60 deg. C. during the application of the composition. In one embodiment, the temperature of the mandrel can be incrementally increased or decreased during the coating process to another temperature. Alternatively, the temperature of mandrel 24 can be adjusted, i.e., increased or decreased, subsequent to the termination of the application of the coating composition, such that during the application of the coating composition, temperature of mandrel 24 is at, for example, room temperature. In the embodiment that heating pin 54 is used, obviously the pin 54 needs to be inserted into the bore of the stent and the heat applied subsequent to the application of the coating composition. In one embodiment, heating pin 54 can be contacted with the inner surface of the stent during the drying process.

The coating composition can include a solvent and a polymer dissolved in the solvent and optionally a therapeutic substance or a drug added thereto. Representative examples of polymers that can be used to coat a stent include ethylene vinyl alcohol copolymer (commonly known by the generic name EVOH or by the trade name EVAL), poly(hydroxyvalerate); poly(L-lactic acid); polycaprolactone; poly(lactide-co-glycolide); poly(hydroxybutyrate); poly(hydroxybutyrate-co-valerate); polydioxanone; polyorthoester; polyanhydride; poly(glycolic acid); poly(D,L-lactic acid); poly(glycolic acid-co-trimethylene carbonate); polyphosphoester; polyphosphoester urethane; poly(amino acids); cyanoacrylates; poly(trimethylene carbonate); poly(iminocarbonate); copoly(ether esters) (e.g. PEO/PLA); polyalkylene oxalates; polyphosphazenes; biomolecules, such as fibrin, fibrinogen, cellulose, starch, collagen and hyaluronic acid; polyurethanes; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrilestyrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; rayon; rayon-triacetate; cellulose; cellulose acetate; cellulose butyrate; cellulose acetate butyrate; cellophane; cellulose nitrate; cellulose propionate; cellulose ethers; and carboxymethyl cellulose.

A "Solvent" is defined as a liquid substance or composition that is compatible with the polymer and is capable of dissolving the polymer at the concentration desired in the composition. Examples of solvents include, but are not limited to, dimethylsulfoxide, chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methyl pyrrolidinone, toluene, and mixtures and combinations thereof.

The therapeutic substance or drug can be for inhibiting the activity of vascular smooth muscle cells. More specifically, the active agent can be aimed at inhibiting abnormal or inappropriate migration and/or proliferation of smooth muscle cells for the inhibition of restenosis. The active agent can also include any substance capable of exerting a therapeutic or prophylactic effect in the practice of the present invention. For example, the agent can be for enhancing wound healing in a vascular site or improving the structural and elastic properties of the vascular site. Examples of agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). Synonyms of actinomycin D include dactinomycin, actinomycin IV, actinomycin $I_1$, actinomycin $X_1$, and actinomycin $C_1$. The active agent can also fall under the genus of antineoplastic, antiinflammatory, antiplatelet, anticoagulant, antifibrin, antithrombin, antimitotic, antibiotic, antiallergic and antioxidant substances. Examples of such antineoplastics and/or antimitotics include paclitaxel (e.g. TAXOL® by Bristol-Myers Squibb Co., Stamford, Conn.), docetaxel (e.g. TAXOTERE®, from Aventis S.A., Frankfurt, Germany) methotrexate, azathioprine, vincristine, vinblastine, fluorouracil, doxorubicin hydrochloride (e.g. ADRIAMYCIN® from Pharmacia & Upjohn, Peapack N.J.), and mitomycin (e.g. MUTAMYCIN® from Bristol-Myers Squibb Co., Stamford, Conn.). Examples of such antiplatelets, anticoagulants, antifibrin, and antithrombins include sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as ANGIOMAX™ (Biogen, Inc., Cambridge, Mass.). Examples of such cytostatic or antiproliferative agents include angiopeptin, angiotensin converting enzyme inhibitors such as captopril (e.g. CAPOTEN® and CAPOZIDE® from Bristol-Myers Squibb Co., Stamford, Conn.), cilazapril or lisinopril (e.g. PRINIVIL® and PRINZIDE® from Merck & Co., Inc., Whitehouse Station, N.J.); calcium channel blockers (such as nifedipine), colchicine, fibroblast growth factor (FGF) antagonists, fish oil (omega 3-fatty acid), histamine antagonists, lovastatin (an inhibitor of HMG-CoA reductase, a cholesterol lowering drug, brand name MEVACOR® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate include alpha-interferon, genetically engineered epithelial cells, dexamethasone, rapamycin, and derivatives or analogs thereof.

EXAMPLE

Figure 6:
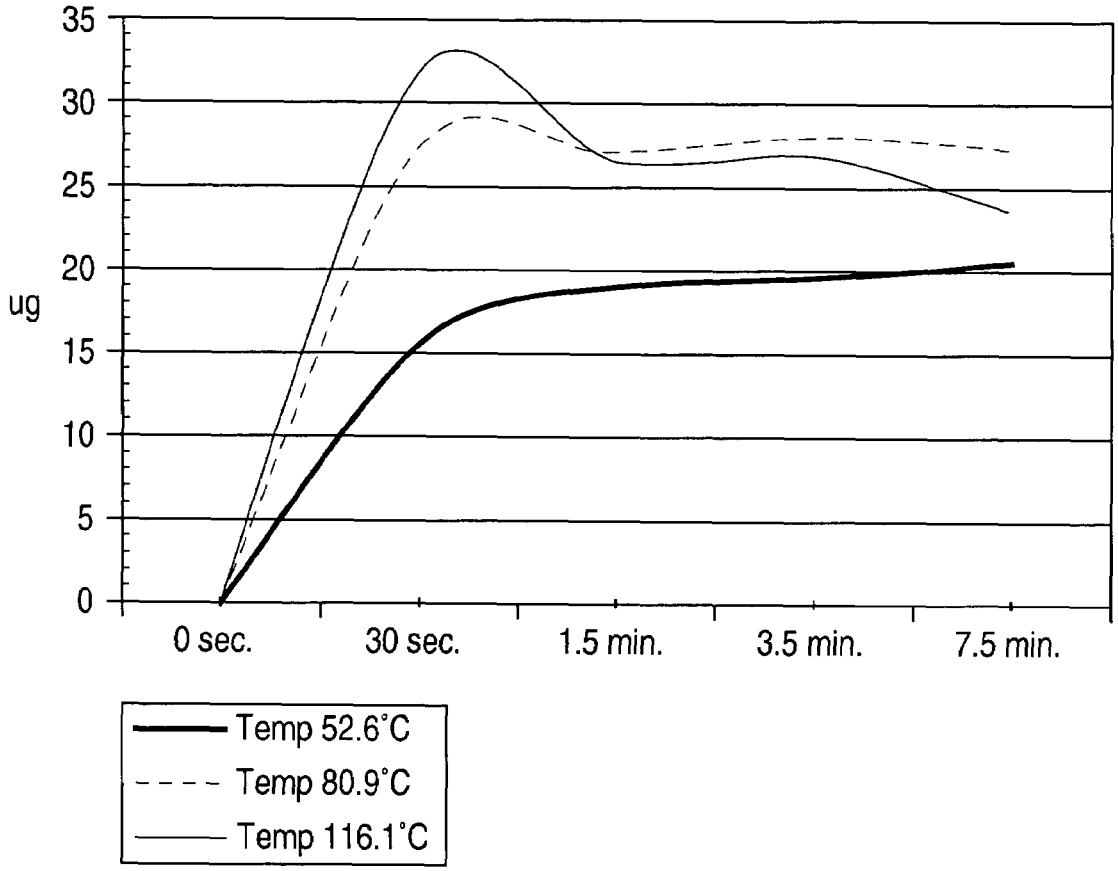
FIG. 6 is a graph illustrating average weight loss versus time.

FIG. 6 depicts the weight loss observed for the three temperature test cases. A base primer layer and drug layer were applied and fully cured on stents. Next a topcoat layer was applied and the conductive dry method was used in place of the oven bake. The coating weight was measured at 0 time and at 30 second intervals out to 7.5 minutes. A thermocouple was used to measure the temperature used by the conductive heat pin. The 3 plots show a significant weight loss after the first minute of drying.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What is claimed is:

1. A method of coating a stent, comprising:

positioning a stent on a mandrel assembly;

applying a coating composition including a solvent to the stent;

adjusting the temperature of the mandrel assembly to change the temperature of the stent such that the evaporation rate of the solvent is modified.

2. The method of claim 1, wherein the mandrel assembly includes a temperature element integrated therewith to allow a user to adjust the temperature of the stent.

3. The method of claim 1, wherein the temperature of the mandrel assembly is adjusted prior to the application of the coating composition to the stent.

4. The method of claim 1, wherein the temperature of the mandrel assembly is adjusted prior to the application of the coating composition to the stent and the temperature in maintained at a generally constant level during the application of the coating composition to the stent.

5. The method of claim 1, wherein the temperature of the mandrel assembly is adjusted prior to the application of the coating composition and the temperature is further adjusted during the application of the coating composition.

6. The method of claim 1, additionally including terminating the application of the coating composition.

7. The method of claim 6, wherein the temperature of the mandrel assembly is adjusted subsequent to the termination of the application of the coating composition.

8. The method of claim 1, wherein the temperature of the mandrel assembly is adjusted during the application of the coating composition.

9. The method of claim 8, wherein the temperature is adjusted incrementally.

10. The method of claim 1, wherein the adjustment of the temperature comprises:

adjusting the temperature of the mandrel assembly to a first temperature;

maintaining the temperature of the mandrel assembly at the first temperature for a duration of time; and adjusting the temperature of the mandrel assembly to a second temperature.

11. The method of claim 1, wherein adjusting the temperature of the mandrel assembly comprises increasing or decreasing the temperature of the mandrel assembly to a selected temperature and maintaining the temperature of the mandrel assembly at or about the selected temperature for a selected time period.

12. The method of claim 1, additionally including receiving feedback from sensors on the mandrel assembly regarding the temperature of the stent.

13. The method of claim 1, wherein the coating composition includes a polymer dissolved in the solvent and optionally a therapeutic substance added thereto.

14. The method of claim 1, wherein the mandrel assembly includes a temperature element disposed within the mandrel assembly and extending along a length of the mandrel assembly for even application of a temperature along the length of the stent, wherein the temperature is below or above ambient temperature.

15. The method of claim 1, wherein the mandrel assembly comprises an element for extending through the stent without being in contact with an inner side of the stent.

16. The method of claim 1, wherein the mandrel assembly comprises a first element for making contact with one end of the stent, a second element for making contact with an opposing end of the stent, and a third element coupling the first element to the second element, the third element extending through the stent such that an outer surface of the third element does not make contact with an inner side of the stent.

17. The method of claim 16, wherein the temperature element is disposed in the third element.

18. The method of claim 1, wherein the mandrel assembly comprises an element for extending through the stent without being in contact with an inner side of the stent and wherein the element extending through the stent includes a temperature element extending across at least the length of the stent.

19. The method of claim 1, wherein adjusting the temperature of the mandrel assembly comprises:

(a) if the solvent of the coating composition has a vapor pressure greater than about 17.54 Torr at ambient temperature, the temperature of the mandrel assembly is adjusted to inhibit evaporation of the solvent; or (b) if the solvent of the coating composition has a vapor pressure less than about 17.54 Torr at ambient temperature, the temperature of the mandrel assembly is adjusted to induce evaporation of the solvent.

20. The method of claim 1, wherein adjusting the temperature of the mandrel assembly is conducted by a temperature element in communication with a temperature controller such that an operator using the temperature controller changes the temperature of the temperature element.

21. The method of claim 1, wherein the temperature is adjusted to a temperature other than ambient temperature.

22. The method of claim 1, wherein the temperature is adjusted to below ambient temperature.

23. The method of claim 1, wherein the temperature is adjusted to above ambient temperature.

* * * * *